US006812393B1

(12) United States Patent
Wilfer

(10) Patent No.: US 6,812,393 B1
(45) Date of Patent: Nov. 2, 2004

(54) CASE FOR MUSICAL INSTRUMENTS

(76) Inventor: Hans-Peter Wilfer, Zum Hackerhof 5 D-08258, Markneukirchen (DE)

( * ) Notice: Subject to any disclaimer, the term of this patent is extended or adjusted under 35 U.S.C. 154(b) by 507 days.

(21) Appl. No.: 09/713,353

(22) Filed: Oct. 24, 2000

(30) Foreign Application Priority Data

Dec. 23, 1999 (EP) ..... 99125763

(51) Int. Cl.[7] ..... G10G 7/02

(52) U.S. Cl. ..... 84/453; 84/329; 84/267; 224/647

(58) Field of Search ..... 84/453, 267, 329; 224/647, 910, 930; D3/218

(56) References Cited

U.S. PATENT DOCUMENTS 2,611,519 A 9/1952 Utterström ..... 224/201
4,237,341 A * 12/1980 Richards ..... 381/75
4,764,962 A * 8/1988 Ekman et al. ..... 381/301
5,711,469 A * 1/1998 Gormley et al. ..... 224/675
6,123,240 A * 9/2000 Fowles et al. ..... 224/600

FOREIGN PATENT DOCUMENTS

| | | |
|---|---|---|
| DE | 9604223 | 12/1996 |
| DE | 9703381 | 6/1997 |
| EP | 0756266 | 1/1997 |
| EP | 0853897 | 7/1998 |
| EP | 0915572 | 5/1999 |
| JP | 9154618 | 6/1997 |

OTHER PUBLICATIONS

Search Report.

* cited by examiner

*Primary Examiner*—Shih-Yung Hsieh
(74) *Attorney, Agent, or Firm*—Sidley Austin Brown & Wood, LLP

(57) ABSTRACT

A case for musical instruments including a shell, elements for carrying the case and attached to the shell, and an arrangement provided on the shell or on one of the carrying elements for receiving a communication device.

6 Claims, 1 Drawing Sheet

CASE FOR MUSICAL INSTRUMENTS

BACKGROUND OF THE INVENTION

1. Field of the Invention

The present invention relates to a case for musical instruments, in particular guitars and including a shell and a device for carrying the case and attachable to the shell, such as shoulder belts and handles.

2. Description of the Prior Art

Generally, the cases for carrying musical instruments, in particular, guitar cases should be so designed that they insure an easy transportation of the musical instrument and, in particular, a carrying comfort. However, a user of such a case has a limited freedom of movement when carrying the case, e.g., when holding the case by a handle. When the carrying device is formed as a handle, the user has only one free hand for other activities. When the case is provided with shoulder belts, the user can use both hands for other activities, however, the freedom of movement of the arms is substantially limited. In each case, carrying and, in particular, using a communication device such as, e.g., a cellular phone is connected with much difficulties. Either the user has only one hand free for the use of the cellular phone or, in the second case, reaching for the phone and its operation are difficult.

Accordingly, an object of the present invention is a case for musical instruments with which carrying and, in particular, using a cellular phone is substantially facilitated.

SUMMARY OF THE INVENTION

This and other objects of the present invention, which will become apparent hereinafter, are achieved by providing, on one of the shell and the carrying device, an element for receiving a communication device.

The receiving element is secured to an outer side of the shell or the carrying device. This makes the communication device, which is stored in the receiving element, easily accessible for the user. The user, when reaching for the communication device or when using it, need not release the handle of the instrument case or take it off the shoulders.

It should be pointed out that the present invention is not limited to guitar cases but can be used with any type of a case for any musical instrument such as cases for percussion instruments, keyboard instruments, drums, brass instruments, string instruments, accordion, and the like.

In accordance with a preferred embodiment of the present invention, the receiving element is formed as a closable pocket with an insertion opening. Such a closable pocket adequately protects the communication device and, in particular, prevents it from falling out.

According to an advantageous embodiment of the present invention, the carrying device is formed of shoulder belts, with the receiving element being provided on the outer side of one of the shoulder belts. In this case, the communication device is accessible even during transportation of an instrument, and the transportation and the use of the communication device are almost ideal.

Advantageously, the communication device receiving element is formed as a separate unit securable to the shell or the carrying element, preferably , by being stitched thereto.

In accordance with a particularly preferred embodiment of the present invention, the receiving element is formed as a pocket and has a cover arranged above the insertion opening and a lock for closing the insertion opening and formed two VELCRO® elements secured, respectively, to the cover and the front side of the pocket.

Preferably, the front side of the pocket has a region formed of a transparent foil for displaying the keyboard region of the communication device so that it become visible and decipherable.

The shoulder belt can have, in its breast area, a retainer for holding a microphone connectable with the communication device formed as a cellular phone, so that the latter can operate in a free-speaking mode. The operation of a cellular phone is a free-speaking and free-hearing, with the use of earplugs, mode keeps both hands of the user free.

When used on stage, strong electromagnetic fields act on the electronics of the communication device. Therefore, the receiving element is provided with EMC protection means, in particular, a protection foil. The protection foil is so secured that an antenna region for the antenna of the communication device remains free of protection, so that the emission and reception are unaffected.

The communication device receiving element is preferably arranged in a reinforced or upholstered region of the shoulder belts, so that the communication device is not easily noticed. Also, the reinforcement and upholstery insures protection of the communication device.

Advantageously, the shoulder belts are releasably connected with the shell. This insures a high flexibility of their use. The receiving element should be secured to a left-shoulder belt when designed for a right-handed person, and be secured to a right-shoulder belt when designed for a left-handed person. Providing releasably connected belts insures an easy rearrangement of the receiving element carrying shoulder belt when needed.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
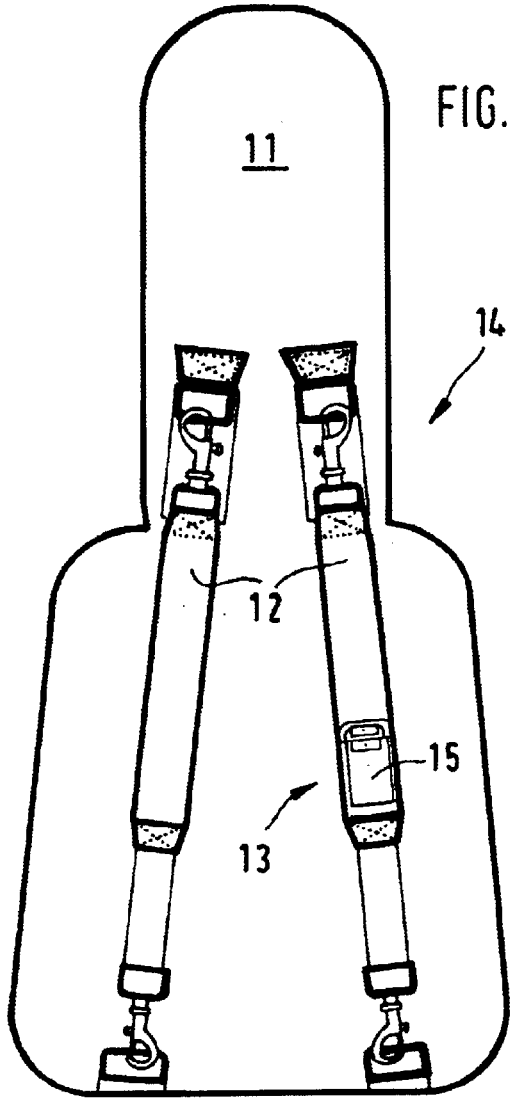
FIG. 1 a front view of a case for a guitar according to the present invention with two shoulder belts, with a pocket for a cellular phone in one of the shoulder belts.

FIG. 1 shows a case 14 according to the present invention for musical instruments, in particular, guitars. The case 14 has a flexible shell 11 and two shoulder belts 12 for carrying the case 14. One of the shoulder belts 12 has means for receiving a communication device, in particular, a cellular phone. Instead of the cellular phone, another communication device, such as a pager, a minicomputer connectable with a large computer or internet, a portable dictaphone, or phonogram, or the like, can be stored in this receiving means.

Figure 2:
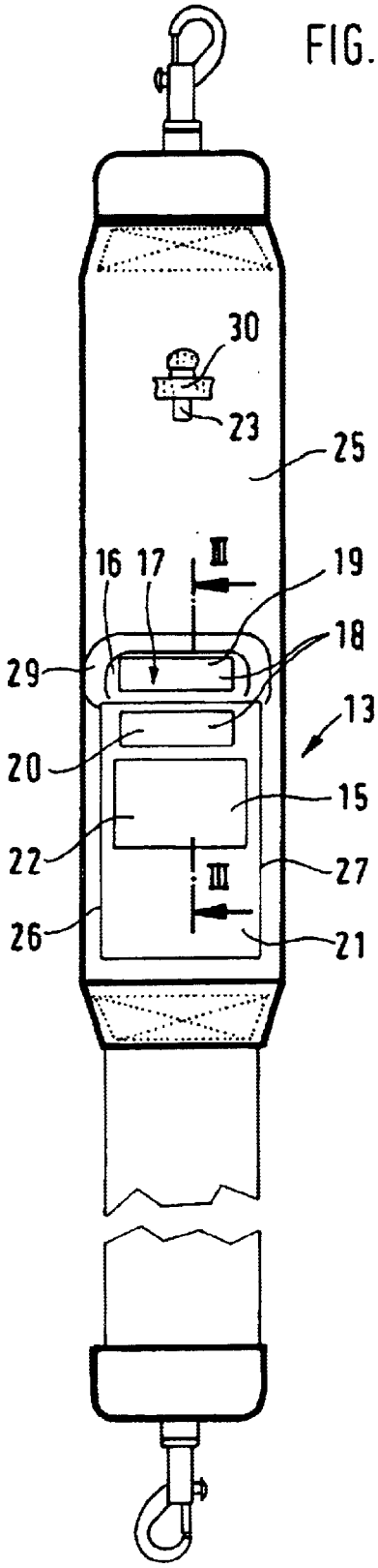
FIG. 2 a front view of a shoulder belt showing principle components thereof.

As shown in FIG. 2, the receiving means is formed as a pocket 15 with a substantially rectangular .insertion opening 17 and a cover 16 arranged above the opening 17. The pocket 15 has a front side 21, two side walls 26, 27, and a bottom 28. The front side 21 can include a transparent foil 22 so that a display and/or a keyboard of a cellular phone is visible.

The cover 16 provides for closing of the pocket 15 and protects the cellular phone from falling out damage. The cover 16 has a reinforced edge 29 and a VELCRO® element on its adjacent to the pocket 15 side. The VELCRO® element 19 cooperates with a mating VELCRO® element 20 provided on the front side 21 of pocket 15. Both VELCRO® elements 19 and 20 form a lock 18 for closing the insertion opening 17 with the cover 16. In a region above the cover 16, a microphone 23 can be located. The microphone 23 is held in a microphone retainer 30 and can be connected with the cellular phone located in the pocket 15, so that the later can operate in a free-speech zone.

Figure 3:
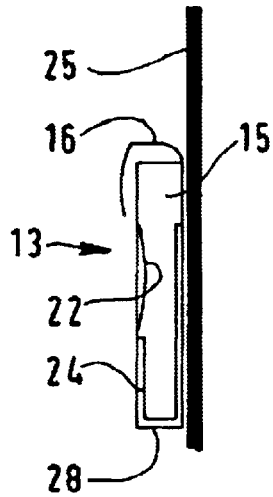
FIG. 3 a cross-sectional view along line III—III in FIG. 2.

As shown in FIG. 3, the pocket 15 is secured to the shoulder belt formed as an upholstery strip 25 by stitching. The upholstery strip 25 forms the rear wall of the pocket 15. The protection foil 24 can be secured to the pocket rear wall or inside the pocket 15 for protecting the communication device from electromagnetic fields. However, the region of the pocket adjacent to the insertion opening 17 has a recess for holding an antenna of the communication device and which remains unprotected.

The shoulder belt according to the present invention permits to use a communication device when carrying a musical instrument.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed:

1. A case for musical instruments, comprising a shell; means for carrying the case and attached to the shell; and means permanently attached to the carrying means for receiving a communication device, wherein the carrying means comprises two shoulder belts, and wherein the receiving means is permanently attached to one of the shoulder belts on an outer side of the one of the shoulder belts.

2. A case as set forth in claim 1, wherein the receiving means is formed as a separate element for a permanent attachment to the carrying means.

3. A case as set forth in claim 1, wherein the one of the shoulder belts has means for holding a microphone connectable with the communication device stored in the receiving means.

4. A case as set forth in claim 1, wherein the receiving means includes a protection foil for protecting electronics of the communication device from electromagnetic fields.

5. A case as set forth in claim 1, wherein the one of the shoulder belts has one of a reinforced region and an upholstery region, and wherein the receiving means is provided in the one of a reinforced region and an upholstery region.

6. A case as set forth in claim 1, further comprising means for releasably connecting the carrying means to the shell.

* * * * *